US005843329A

United States Patent [19]

Deetz

[11] Patent Number: 5,843,329

[45] **Date of Patent: *Dec. 1, 1998**

[54] MAGNETIC PAINT OR INK ADDITIVE

[76] Inventor: Dayton J. Deetz, 43 Taft Ave., Mendon, Mass. 01756

[ * ] Notice: The term of this patent shall not extend beyond the expiration date of Pat. No. 5,609,788.

[21] Appl. No.: 803,332

[22] Filed: Feb. 21, 1997

Related U.S. Application Data

[63] Continuation-in-part of Ser. No. 405,850, Mar. 17, 1995, Pat. No. 5,609,788.

[51] Int. Cl.[6] ..... G09F 7/04

[52] U.S. Cl. ..... 252/62.54; 252/62.55; 273/239; 106/403; 106/460; 106/31.92; 106/456; 422/229; 422/378; 524/431; 524/440; 524/435; 523/334; 428/208; 428/215; 428/216; 428/219

[58] Field of Search ..... 273/239; 524/440, 524/431, 435; 523/333, 334, 442, 457, 458, 512, 515; 442/59, 228, 237, 316, 374, 375, 380; 106/403, 460, 31.92, 456; 252/62.54, 62.55; 428/500, 537.1, 537.5, 411.1, 904.4, 928, 692, 900, 206, 208, 215, 219, 216

[56] References Cited

U.S. PATENT DOCUMENTS

| | | | |
|---|---|---|---|
| 3,300,329 | 1/1967 | Orsino | 117/49 |
| 3,413,135 | 11/1968 | Matson | 106/304 |
| 3,470,021 | 9/1969 | Hendricx et al. | 252/62.54 |
| 3,503,882 | 3/1970 | Fitch | 252/62.54 |
| 3,619,227 | 11/1971 | Tomkinson | 106/304 |
| 3,954,482 | 5/1976 | Novack | 106/1 |
| 4,129,548 | 12/1978 | McDonnell | 260/37 M |
| 4,421,660 | 12/1983 | Hajna | 252/62.54 |
| 4,597,801 | 7/1986 | Stratta et al. | 106/308 Q |
| 4,834,800 | 5/1989 | Semel | 106/403 |
| 4,952,617 | 8/1990 | Ayala et al. | 106/460 |
| 5,016,888 | 5/1991 | Huston et al. | 273/239 |
| 5,112,403 | 5/1992 | Okura et al. | 106/418 |
| 5,587,102 | 12/1996 | Stern et al. | 252/62.54 |
| 5,609,788 | 3/1997 | Deetz | 252/62.54 |

FOREIGN PATENT DOCUMENTS

| | | | |
|---|---|---|---|
| 2150842 | 7/1985 | United Kingdom | 273/239 |

OTHER PUBLICATIONS

Hawby's Condensed Chemical Dictionary. 12 ed, pp. 683, 1993.

*Primary Examiner*—Melissa Bonner
*Attorney, Agent, or Firm*—St. Onge Steward Johnston & Reens LLC

[57] ABSTRACT

Magnetic paint or ink additives are formulated from ferromagnetic particles, preferably iron powder, having a mixed particle range of from about 0.01$\mu$ to about 297$\mu$, and preferably to about 250M and more, preferably from about 0.01$\mu$ to about 37 to 44$\mu$; 6 to 20$\mu$ particles are used in one latex-based embodiment. Preferred additives are formulated by blending the particles with a surfactant, a surfactant mixture, or a surfactant and alcohol mixture in amounts sufficient to suspend the particles; a polyvinyl acetate polyer is used in one embodiment. The additives may be blended with any oil-, latex-, or lacquer-based paint, ink, or coating to form a magnetic paint or coating having a viscosity substantially similar to the paint or ink containing no particles and/or additive. Surfaces such as paper, cloth, wood, wallboard, sheet rock, foam, foam board, plywood, plastic, fiberboard, and the like so coated may be cut with conventional woodworking tools, scissors or knives.

28 Claims, 1 Drawing Sheet

CH-1

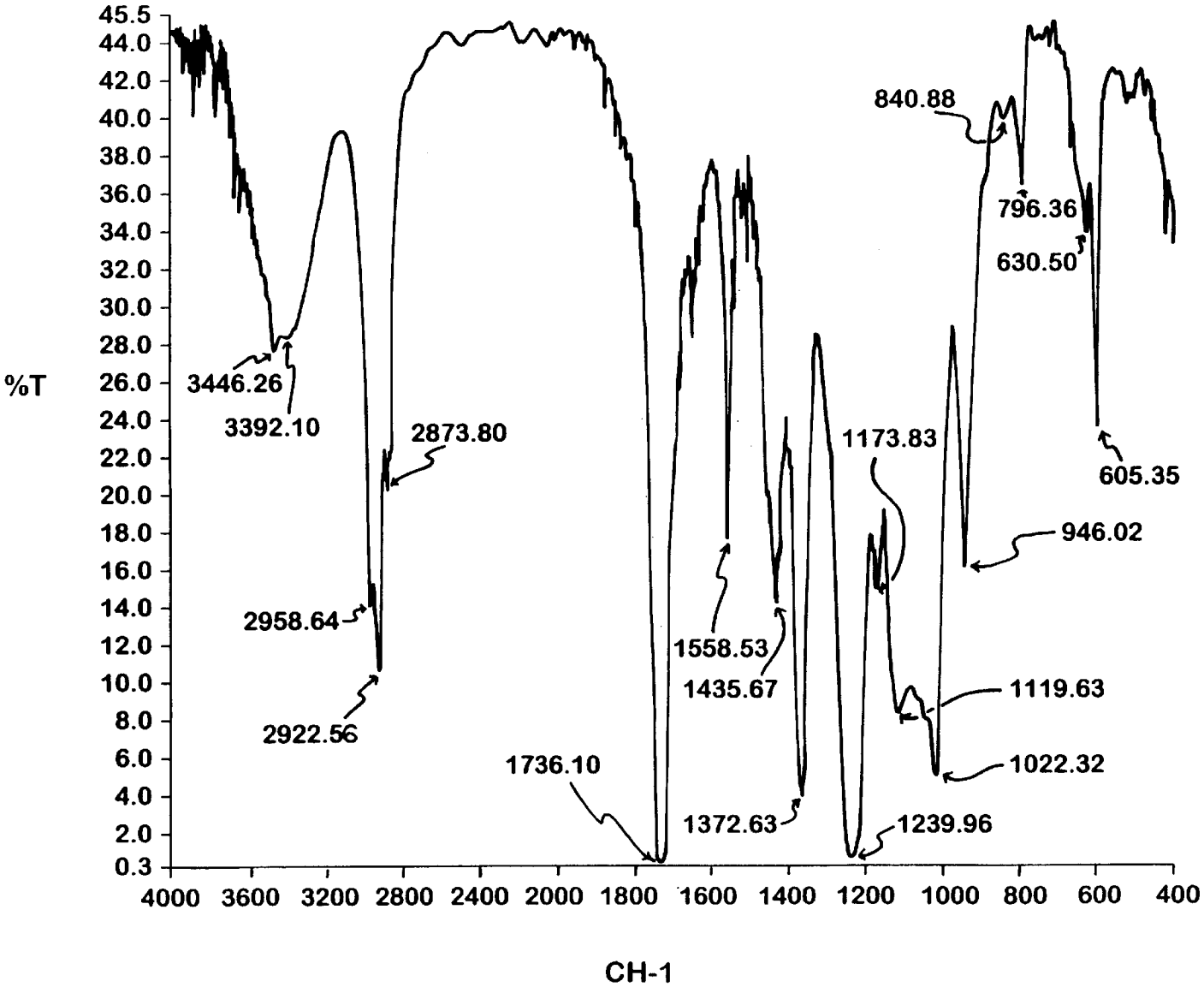
CH-1

MAGNETIC PAINT OR INK ADDITIVE

RELATED APPLICATION DATA

This is a continuation-in-part of U.S. application Ser. No. 08/405,850, filed Mar. 17, 1995, which issued on Mar. 11, 1997 as U.S. Pat. No. 5,609,788.

TECHNICAL FIELD OF THE INVENTION

This invention relates to magnetic paint or ink additives, paint or other coatings containing the additive, and substrates coated with the magnetic paint or ink coating.

BACKGROUND OF THE INVENTION

Metallic particles have been incorporated in previously described compositions, typically for use as metal repair formulations, metallic paint finishes, and colorants.

Orsino, et al., disclosed a process of polymerizing olefinic materials directly onto metal particles and particle clusters using an organometallic-transition metal catalyst system, and to processes of making articles from the encased metal materials by molding, casting or extruding (U.S. Pat. No. 3,300,329). A variety of metals were so treated in the examples, including lead, boron, mercury, copper, gold, magnesium, aluminum, silicon, sponge iron, iron-silicon, nickel, manganese, and chromium. In example 14, a ferromagnetic plastic disc of iron with 10.3% polyethylene was made.

In U.S. Pat. No. 3,413,135, Matson prepared novel iron oxide pigments by contacting an aqueous presscake of hydrated feric oxide with a mixture of an aromatic monocarboxylic acid such as benzoic acid and at least one higher fatty acid and working the mixture. A pigment was obtained upon separation and washing of the solid phase. Similarly, Tomkinson precipitated iron oxide with coloring matter to obtain pigments for bricks, plastics, textiles, and paints in U.S. Pat. No. 3,619,227. In one disclosed method, the coloring matter was formed in situ in an aqueous medium in which the precipitated iron oxide particles was suspended, and pigment was obtained from the suspension.

A corrosion-resistant primer or coating material containing stainless steel planar flakes of a rather critical geometry was disclosed by Novack in U.S. Pat. No. 3,954,482. The flakes, used only in certain proportions (about a pound per gallon primer), were $\frac{1}{3}\mu$ in thickness and had a surface dimension of about $10\mu$ to $40\mu$. The coating was disclosed as particularly efficacious as a one-coat anti-corrosive.

Okura, et al., also used plate-like particles in coating compositions for automobiles (U.S. Pat. No. 5,112,403). The particles were iron oxide, and had an average particle diameter of 0.5 to $5.0\mu$, a lamillar thickness of 50 to 500 Å and a plate ratio of 50:1 to 500:1. The composition further contained at least one pigment, a film-forming polymer, and an organic solvent.

In U.S. Pat. No. 4,129,528, McDonnell disclosed a two component system comprising a liquid polymerizable resin and a hardener, wherein one or both components contained a ferrosilicon alloy. On mixing the two components together, polymerization occurred, forming a composition useful as a metal repair or reclamation material.

Colloidal size particles such as an inorganic solid (titanium dioxide or magnetic iron oxide) encapsulated in a hydrophobic polymer such as a styrene polymer were disclosed in U.S. Pat. No. 4,421,660 to Hajna. They were disclosed as useful for a variety of applications, including separations, radiation absorption, magnetic paints, electrically resistive barriers, toners in electrophotographic applications, electroconductive additives for plastics, pigments in paint and ink formulations, and diagnostic materials. However, the process for preparing the matrix particulates was fairly complicated. It involved a polymerization wherein a hydrophobic monomer was dispersed in an aqueous colloidal dispersion of the inorganic particles that were preferably 0.005 to $0.1\mu$ in size and then subjected to emulsion polymerization. The polymerizations generally employed free radicals; typical reactions involved heating with agitation under nitrogen and then adding a catalyst or free radical initiator. The matrix particulates so formed were separated from the aqueous continuous phase of the dispersion by conventional means such as drying.

Stratta and Stasiak dispersed ferromagnetic powder using a novel dispersing agent containing silylated alkylene oxide copolyethers or isocyanatoalkyl silanes in combination with phosphate esters for use in the manufacture of magnetic coatings for audio and video tape (U.S. Pat. No. 4,597,801). To achieve high information density storage on the tapes, the powders employed were of a very fine, high quality type that exhibited high coercive strength required by the electronics industry. For example, a cobalt-doped magnetic iron oxide particle size illustrated was $0.2\mu$ in length; another that was not doped was $0.06\mu$ by $0.35\mu$ (column 11, lines 29 to 35).

In U.S. Pat. No. 4,834,800 to Semel, iron or steel powders were mixed with an alloying powder and a binding agent exhibiting certain properties. The agent was a film-forming resin insoluble in water comprising a vinyl acetate or methacrylate polymer, a cellulosic ester or ether resin, or an alkyd, polyurethane or polyester resin. The specific binding agents were disclosed as useful in enhancing the physical properties of the powder or sintered articles made from the powder. Where the binding agent was a substance that pyrolyzed relatively cleanly, residues of carbon or other chemicals were avoided during sintering of the composition.

In U.S. Pat. No. 3,503,882, Fitch disclosed a paint composition containing iron powder and an epoxy ester resin with an emulsifiable polyethylene wax and an organophilic alkyl ammonium bentonite dispersed in a paint hydrocarbon solvent when applied to a substrate and dried, a surface to which magnetic symbols will adhere and which will accept chalk markings. The iron powder employed in the oil-based paint formulation was rather coarse, at least 100 to 200 mesh, with over half preferably over 200 mesh, and comprising from about 70 to about 85% by weight, based on the combined weight of the iron powder and epoxy ester resin. The product was thus so coarse that it was brushed on, rather than rollered or sprayed, and fumes from the paint solvent are currently regarded as toxic.

Stem and Treleaven disclosed a magnetic latex paint composition comprising a carrier, particulate magnetically permeable material, a binder and a thickening agent having thixotropic and viscosity characteristics such that the paint composition has high viscosity characteristics when stationary, and low viscosity when shear forces to the paint as it is applied to a wall surface (U.S. Pat. No. 5,587,102). Particulate iron no smaller than 350 mesh was employed with synthetic clay as a thickening agent to keep particles in suspension. Thus formulated, drying retarders were necessary so that a smooth surface after paint application could be achieved without lap marks. When the paint dried, magnetic objects could be mounted on the surface, held in place by the interaction with the magnetically permeable material. There was no suggestion of a universal magnetic paint additive, or of simpler paint formulations.

It would be desirable to have a magnetic paint, ink or coating, or paint additive, that is simple and safe to make and use, and inexpensive.

SUMMARY OF THE INVENTION

It is an object of the invention to provide magnetic paint additives useful for paints, inks or other coatings, including pigmented additives.

It is another object of the invention to provide magnetic paints, coatings, and inks.

It is a further and more specific object of the invention to provide a magnetic paint or ink additive that is economical, easy to use, and useful in oil-, latex-, or lacquer-based paints, inks and coatings.

These and other objects are achieved by the present invention, which provides a magnetic paint additive comprising a mixture of ferromagnetic particles ranging in size from about 0.01$\mu$ to about 297$\mu$, and preferably to about 250$\mu$, and more preferably from about 0.01$\mu$ to about 74$\mu$, more narrowly from about 0.01$\mu$ or 37 to 44$\mu$. One embodiment particularly suited for latex paint employs particles having a particle size of about 6 to about 20$\mu$. When added to paint or ink in amounts that do not substantially change the viscosity of the magnetic product, this particle size and range blends right in with the paint or ink and is particularly efficacious in providing a smooth magnetic surface when the paint or ink has dried. Preferred ferromagnetic particles comprise iron powder. In some embodiments, about 500 grams to 4000 grams of iron powder or other ferromagnetic particles are added per gallon of paint.

In preferred embodiments, magnetic paint additives comprise ferromagnetic particles and a surfactant or surfactant mixture, or a surfactant/alcohol mixture, blended with the particles in amounts sufficient to form a dispersion which can then be conveniently used by simply blending with the paint or coating additive. In some embodiments, about 4000 grams of 1$\mu$ to 70$\mu$ iron powder are blended with about 800 grams of a polyvinyl acetate latex emulsion with one or more surfactants, but the amount varies depending on the nature of the particles and the surfactant used. As illustrated hereafter, some magnetic paint additive embodiments employ higher amounts of particles, e.g., 2 to 3 parts particles per part surfactant blend.

Additives of the invention so formulated are then simply blended into any oil-, latex- or lacquer-based paint, ink or coating in proportions that do not significantly change the viscosity of the paint or ink (i.e., by no more than about 25%), and then painted on a surface in a conventional manner. As mentioned above, in some embodiments, from about 500 grams to 4000 grams of particles are employed per gallon of paint. Upon drying, the painted surface is magnetic. Thus, this invention encompasses magnetic paints, inks, and the like coatings.

This invention further encompasses substrates coated with magnetic products of the invention such as magnetic sign boards and toys. Typical surfaces include rigid wall board, wood, sheet rock, foam, plywood, plastic, fiberboard, paper, cloth, and the like painted or coated with magnetic products of the invention are advantageous because they can be cut on site with conventional wood-working tools sissors or knives to provide signs, games, and the like.

BRIEF DESCRIPTION OF THE FIGURE

FIG. 1 is a FT-IR spectral tracing of a polyvinyl acetate emulsion useful in preparing magnetic additives of the invention.

DETAILED DESCRIPTION OF THE INVENTION

This invention is based upon the finding that powdered iron of a certain mesh size range provides an inexpensive and simple paint or ink additive that can be combined with a variety of paint and coating types that, when dried, form a magnetic paint or coating. Preferred additives are mixtures of ferromagnetic particles and at least one surfactant to facilitate mixing with the paint or coating.

In the practice of the invention, ferromagnetic particles having a size range between about 0.01$\mu$ to about 27$\mu$ typically of a mesh size greater than 50, i.e., having a particle size of about 297$\mu$ or smaller, preferably smaller than 250$\mu$ (60 mesh), are mixed with surfactant. Mixtures of particle sizes yield superior surfaces, and use of different size ranges can be varied to yield different surface texture characteristics. For example, a coarse surface is obtained by use of 50 to 400 mesh particles (37$\mu$ to 297$\mu$). Use of a finer particle mixture, e.g., as small as 0.1$\mu$ to 10$\mu$, yields smoother surfaces.

For superior results on conventional painted surfaces such as plaster walls, wallboard, or interior woodwork, preferred particles exhibit a mixture of sizes that vary up to about 74$\mu$ (i.e., 200 mesh or higher), more narrowly up to 44$\mu$ (325 mesh), and even more narrowly up to 37$\mu$ (400 mesh). Thus, in one embodiment, the particles range from about 0.01$\mu$ to about 75$\mu$. In other embodiments, the particles range from about 0.01$\mu$ to about 44$\mu$ (325 mesh), or from about 0.01$\mu$ to about 37$\mu$ (400 mesh), or between about 0.01$\mu$ to 30$\mu$. Some embodiments employ finer powders, e.g., those having a size range of about 0.01$\mu$ to 20$\mu$, or 0.01$\mu$ to 15$\mu$, or 0.01$\mu$ to 10$\mu$. Slightly coarser grades are used in other embodiments, e.g., having a particle size range between about 5$\mu$ to 15$\mu$. An advantage of using iron powders much finer than that disclosed by Fitch cited above is that the particles stay in suspension for longer periods and paints and inks formulated with them can be rollercoated, spray painted, or screened without clogging equipment nozzles, tips, screens, hoses and the like.

Use of a broad range of mesh sizes, e.g., 1$\mu$ to 75$\mu$, results in good adhesion and a strong, flat magnetic surface after drying. The inclusion of larger particles yields a superior magnetic product exhibiting stronger magnetism (holding power) for various applications, so the use of a broad range of particles is a wise decision for strength as well as cost (less refinement).

Any type of ferromagnetic particle may be used in the practice of the invention. Ferromagnetic particles useful in the present invention include, but are not limited to, powdered iron, magnetic iron oxide, magnetic powdered steel, and magnetic iron alloys with nickel, zinc, copper, and the like, and mixtures thereof. Oxidized iron is generally not preferred for many embodiments as it tends to discolor the paint, particularly when used in water-based paints. However, iron oxide is employed in embodiments wherein pigmentation is desired; in one embodiment, coloring matter is formed in situ in an aqueous medium in which precipitated iron oxide particles are suspended, and pigment is obtained from the suspension. Powdered iron is preferred in many embodiments. Examples of some products useful in the practice of the invention are given hereafter.

Though the ferromagnetic particles may be added directly to any paint, ink or coating composition to provide a magnetic product, as mentioned above, many preferred embodiments employ a wetting agent or emulsifier to assist in the dispersion of the particles in the paint. Any wetting agent or emulsifier, or combination of wetting agents and/or emulsifiers, that form a stable dispersion with the ferromagnetic particles may be employed. Where employed, surfactants are typically added in an amount sufficient to wet the particles. The emulsifiers may be anionic, cationic or neutral. Useful surface active or wetting agents include, but are not limited to, ethylene glycol and/or propylene glycol, condensates of ethylene oxide with propylene oxide, fatty acid salts such as sodium/potassium oleate, metal alkyl sulfates such as sodium lauryl sulfate, salts of alkyl aryl sulfonic acid such as sodium dodecylbenzene sulfonate, polysoaps, polyoxyethanols, and the like. Ethylene glycol, propylene glycol, or mixtures thereof are employed in some embodiments. Conventional paint additive surfactants such as Merpol OJ® or Merpol® SH, nonionic ethylene oxide-based surfactants or Alkanol ACN® obtainable from DuPont are employed in other embodiments. A polyvinyl acetate polymer and/or copolymer such as Floetrol® is particularly advantageous in embodiments for a universal additive for latex or oil magnetic paints, inks, or coatings.

Mixtures of surfactants with solvents such as alcohols can also be employed; diacetone alcohol combined with a surfactant is preferred in these embodiments. In some embodiments, mixtures of Merpol OJ®, Merpol® SH, or Alkanol ACN® with diacetone alcohol are employed. These are formulated to provide a final paint or ink formulation exhibiting a viscosity suitable for smooth spreading using conventional paint mixing techniques known to those skilled in the art. Examples are given hereafter.

The choice of surfactants depends to some extent on the paint base into which the additive is mixed. As illustrated in the examples hereafter, it has been found that use of certain surfactants with iron powder may affect the viscosity of the paint so that a solvent such as an alcohol may be needed to obtain a paint with a satisfactory consistency. Some surfactants, e.g., Merpol OJ®, are pastes that require dilution with a solvent such as alcohol prior to use. Drying time may also be affected when certain surfactants are used with certain paint bases. In many embodiments, Merpol OJ® or Alkanol ACN® or a mixture of these with each other or with an alcohol may be preferred because these surfactants are suitable for latex-, oil- and lacquer-based paints. Preferred surfactants form an additive that does not settle out when stored at room temperature (i.e., about 20° to 25° C.) for about a year. Surfactants, iron powder having a particle size range between about 0.01$\mu$ and 250$\mu$, and a resin selected from the group consisting of a phenolic resin, a polyurethane, an acrylic, and mixtures thereof form an additive that does not settle out when stored at room temperature for about a year.

Some additive embodiments further contain a resin in the composition, particularly in the formulation of certain phenolic-based or acrylic-based coatings of the invention. Typical resins are phenolic, polyurethane, an acrylic, or mixtures of these. On the other hand, an oil-based additive embodiment is formulated in the substantial absence of an epoxy ester resin.

Some additive embodiments optionally contain whiteners, which are typically added in amounts sufficient to lighten the coating. Useful whiteners include, but are not limited to, antimony oxide, zinc oxide, titanium oxide, zinc sulfate, and mixtures of these with each other and with other whiteners conventionally used in the art. Sodium benzoate is added to some additive embodiments to inhibit rusting, typically in an amount ranging from about 1.5% to about 3% per weight iron, but other antirust compounds or mixtures known to those skilled in the art may also be employed.

Preferred paint embodiments yield a wet magnetic paint, ink or coating additive having the consistency of a thick cake batter, i.e., containing a maximum amount of pre-wet iron. An advantage of the invention is that those not skilled in the art can blend paints with this additive very simply, so obtaining a paint with an appropriate viscosity does not present a problem in the practice of the invention.

Particles are added directly to the chosen emulsion and then to the paint in amounts that do not change the viscosity of the paint significantly. Preferred additive embodiments change the viscosity of the final paint by less than 25%; particularly preferred embodiments change the viscosity by less than about 15%, and, in some embodiments, less than by about 10%. An average gallon of paint weighs between about 4000 to about 6000 grams. Typically, about 500 grams to 8000 grams of particles are used per gallon, thus yielding a typical magnetic paint product weight of between about 5000 to about 10,000, more narrowly from about 6000 to about 9000 grams. In many embodiments, the iron powder or other ferromagnetic particles are blended with a surfactant emulsion blend until the viscosity is between 5 and 40% thicker than the embodiment intended for use. Surfactants, iron powder having a particle size range between about 0.01$\mu$ and 250$\mu$, and a resin selected from the group consisting of a phenolic resin, a polyurethane, an acrylic, and mixtures thereof are blended until the viscosity is between about 5 and 40% thicker than the coating to which it is added. The additive is then blended with coatings to the specific viscosity intended for use with mechanical coating equipment so that the magnetic coating won't clog tips, screens, hoses, and the like used for application.

In one embodiment, about 5 to 90 parts ferromagnetic particles are employed to yield 100 parts magnetic paint additive. In other embodiments, about 2 to 3 parts particles are mixed with one part surfactant blend to yield magnetic paint additives of the invention. Specific examples are given hereafter. The surfactant or surfactants are simply blended with the ferromagnetic particles. Preferred oil-based embodiments do not contain epoxy ester resin. It is an advantage of the invention that the paint additive containing the particles can be mixed with a portion of top coat paint, so that the purchase of only one paint is required in the practice of the invention.

An advantage of the invention is that the magnetic paint or ink additive may be added to any oil-, latex- and lacquer-based paints and fluid coatings. It is simply mixed in, and requires no special processing heat or polymerization steps. Universal additives of the invention can be formulated for most inks and paints, providing magnetic coatings having specific, controlled properties. For most paints, the magnetic paint can be used in a one-coat operation. It can thus be used to create a magnet-attracting surface virtually anywhere one can paint. It can also be used as a primer under wallpaper. Magnetic paint is ideal for message centers, conference rooms, school (class and dorm) rooms, homes, offices, cupboard interiors, workshop walls, and the like, eliminating thumb tacks and tape for messages, posters, artwork, and interactive displays.

By using mache unit (MU) metal instead of iron powder, electromagnetic force (E.M.F.) reducing magnetic paint is formulated. This is useful for isolating electrical fields, to shield electrical guitars and scientific equipment, and the like. It is also useful for painting the walls of a child's room or the like to reduce E.M.F. penetration from the environment into homes and schools. Walls so coated have the advantage of being magnetic.

Another advantage of the invention is that it can be used to make magnetic sign boards, toys and games, and the like. Magnetic paint or ink can be applied to rigid wall board, wood, sheet rock, foam, foam board, plywood, paper, vinyl, chipboard, polystyrene, polyvinyl chloride (PVC), plastic, cloth, or fiberboard that can be cut on site with conventional woodworking sissors knives or computer plotters, rather than metal-cutting, tools. The signs have many applications in schools, restaurants, offices, tradeshows, stores, and the like. When mixed with various types of stone, magnetic paint can also be used to make chalkboards that are magnetic. Examples are given hereinafter. A substrate premanufactured with a dry mill finish of, for example, 1 to 6 mils containing between about 0.01 and 3 grams of ferromagnetic particles having a size range of from about 0.01$\mu$ and 250M per square inch is preferred in one embodiment. Coatings of the invention may afterwards be coated with adhesive so that the product can be laminated to another surface, sandwiching the magnetic coating between surfaces.

With or without an adhesive, this invention thus provides magnetic products comprising at least two layers having a paint, ink, or coating composition sandwiched between the layers. The product may comprise more than two layers, wherein a magnetic paint, ink, or coating composition of the invention is sandwiched between only two layers or between multiple layers. Thus, this invention provides magnetic wallpaper, contact paper, printed stock for game boards, vinyl and the like. It also provides magnetic products that are cloth fibers coated or impregnated with compositions of the invention.

Magnetic paints or inks of the invention also have medical applications. A universal paint, ink or coating additive is prepared with ferromagnetic particles ranging from 0.01 to 250M blended with an alkanol or Merpol®-type of surfactant, preferably with an H.G.C. level of about 13 to 15 to aid in efficient wetting for aqueous or solvent-based products employed for character recognition on printed products used with X-rays.

Magnetic coatings have further application for tire manufacture. Ferromagnetic particles with a size range of from about 0.01$\mu$ to 250M are blended with a polyurea coating or a barium-based compound that can withstand high temperatures of about 100° to 250° C. and higher. Kevlar® or other fibers are coated with the magnetic product, so that magnetic machinery can hold the fibers in place. The flat properties that the ferromagnetic powders bring to the coating aid in adhesion to the fibers, as Kevlar® fibers have such a high surface tension so that many coatings tend to roll off them.

Other advantages of the invention will be apparent to the skilled artisan from a reading of the Examples below.

EXAMPLES

The following examples are presented to further illustrate and explain the present invention and should not be taken as limiting in any regard. Unless otherwise mentioned, all parts and percentages are by weight, and are based on the weight at the particular stage of the processing being described.

Example 1

In this example, ferromagnetic particles useful as a magnetic paint additive are described.

One analysis of a metallic powder useful in the invention shows an iron base that contains 0.15 to 0.2% carbon, 0.6 to 0.9% molybdenum, 0.04% phosphorus (maximum), and 0.05% sulfur. The specific gravity is 7.83 and the melting point is 1430° C. The powder contains the following particle size range:

| screen size | weight % |
|---|---|
| 200 | 0.3 |
| 230 | 14.9 |
| 270 | 23.6 |
| 325 | 13.0 |
| 400 | 16.3 |
| [PAN | 31.9] |

Another iron product useful in the practice of the invention was a crude powder without added $SiO_2$ which exhibited the following characteristics:

| Appearance @ 25° C. | Uniform Powder |
|---|---|
| Color (Visual) | Grey |
| Apparent Density (g/cm$^3$, MP-488-W) | 2.0–3.0 |
| Tap Density (g/cm$^3$) | 3.5–4.5 |
| True Density (g/cm$^3$) | 7.50–7.75 |
| Sieve Analysis (200 Mesh) | 0.3 Maximum |
| Average Particle Diameter (microns) | 4–6 |
| % Iron (Mass Balance, MP-1095-W) | 97 Mininium |
| % Carbon | <1 |
| % Oxygen | 0.6 Maximum |
| % Nitrogen | <1 |

Another coarse, unmilled iron powder useful in the practice of the invention exhibited the following characteristics:

| Appearance @ 25° C. | Uniform Powder |
|---|---|
| Color | Grey |
| Apparent Density (g/cm$^3$, MP 488-W) | 1–3 |
| Tap Density (g/cm$^3$) | 1.5–3.5 |
| True Density (g/cm$^3$) | 7.0 Minimum |
| % On 200 mesh (HSV-6) | 0.5 Maximum |
| Average Particle Diameter (microns) | 7–9 |
| % Iron (Mass Balance, MP 1095-W) | 97 Minimum |
| % Carbon | 1 Maximum |
| % Oxygen | 0.5 Maximum |
| % Nitrogen | 1.0 Maximum |

Another powder useful in the invention is 99.5% iron, and has a particle size range of 6$\mu$ to 9$\mu$. Yet another powder is a MU mixture of molybdenum and iron.

Example 2

This example describes several magnetic paint additives that can be prepared for use in making magnetic paints according to the invention.

Alkanol ACN® obtained from DuPont, a 0.5% to 5% solution, was mixed with one part diacetone alcohol to form a wetting agent and then 6 parts 6–9 micron iron powder was added to form a magnetic additive that performed well in both oil- and latex-based paints when added to them in amounts sufficient to yield a consistency like that of cake batter or honey. Undiluted with alcohol, the same surfactant performed well with iron powder in oil-based paint, but it did not disperse the particles well in latex-based paint.

Merpol SH® obtained from DuPont, a 0.5% to 5% solution, was mixed with one part diacetone alcohol to form a wetting agent to which 4 parts 6 to 9 micron iron powder were added to form an additive that performed well with both oil- and latex-based paint. The same surfactant performed without dilution with alcohol prior to adding the iron powder. Alcohol could be added directly to the magnetic paint containing the magnetic additive and paint to alter viscosity to a thick cake batter or honey consistency if the paint thickened on standing or overnight storage.

Another additive was prepared by mixing one part Merpol OJ® obtained from DuPont with one part diacetone alcohol and 6 parts 6 to 9 micron iron powder. This performed well as an additive with both oil- and latex-based paints. The surfactant could not be used without the alcohol solvent dilution because it was a thick paste.

All three DuPont products performed well in the paints, yielding superior metallic paint surfaces after drying.

Example 3

A magnetic paint additive is made by mixing 30 to 40 parts powdered iron having a mixed mesh size ranging from 0$\mu$ to 74$\mu$ (200 mesh) with 70 parts ethylene glycol ($N^{20}$ 1.4670; $d^{D}$ 1,128). When mixed with oil-base paint, the magnetic paint so formed performs and dries like paint containing no additive. When mixed with latex-base paint, the magnetic paint performs like paint containing no additive, but the drying time is slowed somewhat.

Example 4

Magnetic sign boards are prepared by applying a coating of the invention to thin films of paper or plastics than than then be laminated to one another, or simply applied directly to a more rigid substrate. The coating typically dries to a thickness of about 1 to 6 mils. The product is magnetic and can be cut on sight with conventional woodworking tools, scissors, or knives.

Other magnetic sign boards are prepared by spraying a paint of Example 1 on medium density fiber board. The coating dries to a thickness of about 0.002" to 0.01". The product is magnetic and can be cut on sight with conventional woodworking tools.

A magnetic chalkboard is prepared by mixing iron powder in a desired color of paint and then adding rotton stone and F.F. pumas. This dries flat, leaving a chalkboard surface that is magnetic.

Example 5

An E.M.F. reducing magnetic paint is made by mixing MU metal particles known to those skilled in the art with surfactants as in Example 2 above.

Example 6

A magnetic paint additive particularly suitable for latex paints is made by combining iron particles ranging in size from 0.01$\mu$ to 250M with polyvinyl acetate polymer or co-polymer as a wetting agent in a weight ratio of 4000 grams of iron to 1700 grams polyvinyl acetate. When mixed with latex paint, the product showed less than 10% settling out when stored at room temperature over a one year. A good suspension and non-clogging application is also achieved using ferromagnetic particles having a size range between about 6$\mu$ and 15$\mu$.

The same additive performs in oil-based inks/paints and coatings with no noticeable change in drying time.

Example 7

Iron particles having a particle size ranging from 0.01 micron to 250M, predominantly 0.01 to 37 microns, is blended with a polyvinyl acetate wetting agent, Floetrol®, in weight ratios between about 60% iron and 40% polyvinyl acetate to about 90% iron and 10% polyvinyl acetate to form a magnetic paint additive. The additive is blended with a latex paint, ink or coating and applied to paper, vinyl, chip board, wallpaper, or polystyrene to yield a pre-manufactured substrate with a dry mill finish of 1 to 6 mils containing between about 0.01 and 3 grams of iron particles per square inch.

Example 8

A latex paint/ink containing iron particles in the range of from about 0.001$\mu$ to 325 mesh is blended with polyvinyl acetate and a surfactant to aid in suspension and wetting of the iron. An iron weight of 2000 to 8000 grams per gallon (i.e., about 4000 to 6000 grams paint) yields a coating with no noticeable viscosity change and leaves a high quality finish. Other paint or ink coatings employ iron particles having a size range of from about 0.01$\mu$ to 250M.

Example 9

A coated substrate less than 10 mils in thickness is laminated to another surface, enclosing the coating between the two surfaces so that the pre-printed product can be coated without covering graphics to produce game board paper, wallpaper, magnetic vinyl, and the like.

Example 10

An FT-IR of a polyvinyl acetate (PVA) useful in the formulation of magnetic additives of the invention is set out in FIG. 1.

A magnetic paint of the invention is prepared by wetting any iron powder of Example 1, or mixtures, with this PVA product at ratios of about 25% emulsion to about 75% iron, to yield a magnetic paint weighing about 9500 grams/gallon.

The above description is for the purpose of teaching the person of ordinary skill in the art how to practice the present invention, and it is not intended to detail all those obvious modifications and variations of it which will become apparent to the skilled worker upon reading the description. It is intended, however, that all such obvious modifications and variations be included within the scope of the present invention as defined in the appended claims. The claims are meant to cover the claimed components and steps in any sequence which is effective to meet the objectives there intended, unless the context specifically indicates the contrary.

I claim:

1. A coating additive composition comprising ferromagnetic particles ranging from greater than 2.0$\mu$ to about 250$\mu$, polyvinyl acetate, and at least one surfactant added in an amount sufficient to wet the particles.

2. An additive composition according to claim 1 wherein the ferromagnetic particles range in size from greater than 2.0$\mu$ to about 37$\mu$.

3. A additive composition according to claim 2 wherein the ferromagnetic particles range in size from about 5$\mu$ to about 15$\mu$.

4. A coating composition comprising the additive according to claim 1.

5. A coating composition according to claim 4 formulated to contain from about 2000 to about 8000 grams iron particles per yielded gallon of coating.

6. A coating composition according to claim 5 which is latex.

7. A substrate coated with a coating composition according to claim 4 and having a dry mill finish of about 1 to 6 mils, and containing from about 0.01 to about 3 grams of ferromagnetic particles per square inch.

8. A substrate coated with a magnetic coating comprising a paint or ink, or other coating, and ferromagnetic powder having a size range from greater than 2.0$\mu$ and 250$\mu$ and formulated to provide a dry mill finish of about 1 to 6 mils and containing between about 0.01 and 3 grams of ferromagnetic particles per square inch.

9. A substrate according to claim 8 selected from the group consisting of paper, vinyl, chip board, wallpaper, polystyrene, and polyvinyl chloride.

10. A substrate according to claim 8 wherein the coating is latex.

11. A substrate according to claim 10 wherein the ferromagnetic particles range in size between greater than 2.0$\mu$ to about 37$\mu$.

12. A substrate according to claim 11 wherein the ferromagnetic particles range in size between about 5$\mu$ and about 15$\mu$.

13. A coating additive composition comprising ferromagnetic particles ranging from greater than 2.0$\mu$ to about 250$\mu$, a surfactant, and a resin selected from the group consisting of a phenolic resin, a polyurethane, an acrylic, and mixtures thereof.

14. An additive composition according to claim 13 wherein the particles are iron powder having a size ranging between greater than 2.0$\mu$ to about 37$\mu$.

15. An oil-based paint comprising the additive of claim 13 in the substantial absence of epoxy ester resin.

16. A phenolic-based coating comprising the additive of claim 13.

17. An acrylic-based coating comprising the additive of claim 13.

18. An additive for adding to a coating according to claim 14 wherein the viscosity is about 5 to 40% thicker than the coating to which said additive is added.

19. An additive according to claim 14 which does not settle out when stored at room temperature for about one year.

20. A substrate coated with a coating of claim 5 at a thickness of between about 1 and 6 mils, and containing from about 0.01 to about 3 grams of ferromagnetic particles per square inch.

21. A coating according to claim 5 which further comprises a whitener selected from the group consisting of antimony oxide, zinc oxide, titanium oxide, zinc sulfate, and mixtures thereof, added in amounts sufficient to lighten the coating.

22. A coating additive according to claim 1, which further comprises about 1.5% to about 3% sodium benzoate per weight of iron.

23. A magnetic coating comprising an additive having iron in a particle size ranging from greater than 77$\mu$ to 250$\mu$ added in an amount sufficient to yield between about 500 to about 8000 grams per gallon of coating.

24. A magnetic product comprising at least two layers having the iron coating of claim 5 sandwiched between at least two of the layers.

25. A product according to claim 24 which is a game board.

26. A magnetic product comprising a cloth coated or impregnated with the coating of claim 5.

27. A coating comprising the additive of claim 1 formulated to produce a finish with a dry mill thickness of from about 1 to about 6 mils, and having a residual iron content from between about 0.1 and 3 grams per square inch.

28. A magnetic product comprising a substrate coated with a coating containing particulate iron having a size range from greater than 2.0 to about 74 microns, which is formulated to provide a magnetic surface having a dry mill thickness of between about 1 and about 6 mils and containing between about 0.01 to about 3 grams of ferromagnetic particles per square inch, such that the product can be cut with conventional woodworking tools, scissors, and knives.

* * * * *